United States Patent [19]

Kozumplik, Jr. et al.

[11] Patent Number: 4,936,753

[45] Date of Patent: Jun. 26, 1990

[54] DIAPHRAGM PUMP WITH INTERCHANGEABLE VALVES AND MANIFOLDS

[75] Inventors: Nicholas Kozumplik, Jr., Bryan; Richard K. Gardner, Montpelier, both of Ohio

[73] Assignee: The Aro Corporation, Bryan, Ohio

[21] Appl. No.: 202,056

[22] Filed: Jun. 3, 1988

[51] Int. Cl.[5] ..... F04B 39/10; F04B 39/14; F04B 43/06

[52] U.S. Cl. ..... 417/238; 417/454; 417/536

[58] Field of Search ..... 417/534–536, 417/238, 393, 454

[56] References Cited

U.S. PATENT DOCUMENTS

| | | | |
|---|---|---|---|
| 3,039,399 | 6/1962 | Everett | 417/536 |
| 3,207,083 | 9/1965 | Lohry et al. | 417/454 |
| 3,238,890 | 3/1966 | Sadler et al. | 417/536 |
| 3,238,967 | 3/1966 | Smith | 417/471 |
| 3,279,391 | 10/1966 | Masciopinto | 417/536 |
| 3,410,477 | 11/1968 | Hartley | 417/534 |
| 3,782,863 | 1/1974 | Rupp | 417/393 |
| 3,849,033 | 11/1974 | Schnall | 417/454 |
| 4,030,495 | 6/1977 | Virag | 417/435 |
| 4,038,983 | 8/1977 | Mittleman | 417/435 |
| 4,478,560 | 10/1984 | Rupp | 417/393 |
| 4,549,467 | 10/1985 | Wilden | 417/393 |
| 4,623,303 | 11/1986 | Henderson | 417/238 |

OTHER PUBLICATIONS

Warren Rupp Co., "Operating Instructions, Service Manual, Repair Parts List", Sandpiper Double Diaphragm Pump.

*Primary Examiner*—Michael Koczo
*Assistant Examiner*—Eugene L. Szczecina, Jr.
*Attorney, Agent, or Firm*—Allegretti & Witcoff, Ltd.

[57] ABSTRACT

A double diaphragm pump is disclosed. The pump utilizes duckbill and ball-type check valves interchangeably. The check valves are held in place by intake and exhaust manifolds that are convertable to single or dual inlet or outlet manifolds.

1 Claim, 2 Drawing Sheets

DIAPHRAGM PUMP WITH INTERCHANGEABLE VALVES AND MANIFOLDS

BACKGROUND OF THE INVENTION

This invention relates to diaphragm pumps utilizing check valves and manifolds. More specifically, this invention relates to a diaphragm pump having interchangeable duckbill and ball-type check valves and interchangeable dual and single intake or exhaust manifolds.

Double diaphragm pumps are well known in the art. Examples are shown in U.S. Pat. Nos. 4,478,560 and 3,782,863.

In one typical double diaphragm pump, the pump has two pumping chambers or cavities. Each cavity contains a pumping diaphragm spanning the width of the cavity, and the diaphragms are interconnected by a connecting rod. Each cavity also has an intake and exhaust valve, with (i) the intake valve connected through an intake manifold to a source of fluid or other material to be pumped through the pump and (ii) the exhaust valve connected to an exhaust manifold. Movement of the connecting rod in one direction forces one diaphragm to pump fluid or material out of one cavity through its exhaust valve manifold and the other diaphragm to simultaneously pump fluid or material into its particular cavity through its intake manifold and valve. Movement in the opposite direction causes the two diaphragms to do the exact opposite. Thus, the double diaphragm pump accomplishes a nearly constant flow of pumping through the pump by continuously driving the connecting rods back and forth in the pump.

In these prior art pumps, the intake and exhaust valves are usually "check valves." A check valve allows flow in one direction but not the other.

Thus, an intake check valve allows fluid or material from the manifold through the valve into the pumping cavity but not out the cavity through the valve into the intake manifold. Similarly, an exhaust check valve allows fluid or material to move out of the cavity through the exhaust check valve and out the exhaust manifold but not into the cavity through the exhaust manifold and exhaust valve. Only by thus checking the flow of fluid or material through the cavity does the movement of the diaphragm alternately achieve pumping into the cavity through the intake valve (the exhaust valve then stopping any flow of previous exhausts into the cavity) and pumping out of the cavity through the exhaust valve (the intake valve then stopping any flow into the intake manifold.)

In the prior art pumps, manifolds may be a single or double inlet/outlet type depending on the need for high volume flow, ease of connection to a single inlet or outlet source, etc. For both types of manifolds, single or double inlet/outlet, the internal structure has also frequently differed depending upon the type of check valves that they were designed to abut the manifold in the pump.

The prior art pumps have utilized duckbill check valves, ball-type check valves, and others. Duckbill check valves look like a duck's bill, with the bills formed of a resilient material. The bill shape allows fluid to travel from inside the bill to the outside of the bill by forcibly separating the resilient bills outwardly away from one another. The bills do not allow flow in the other direction, however, since fluid flow toward the inside of the bill quickly forces the bills into sealing engagement with each other.

A ball-type check valve operates differently. Fluid flow in one direction forces the ball to abut against a cage-like ring, which allows fluid flow past the ball through the apertures of a cage-like abutment holding the ball in place. On the other hand, fluid flow in the opposite direction forces the ball against a ring seal on the side of the valve opposite the ring cage, and fluid flow ceases as the ball sealingly engages or abuts the sealing ring.

Ball-type check valves are preferred in certain situations, whereas duckbill check valves are preferred in others. The ball-type provides a long lasting valve since it can be constructed of all hardened, inflexible metal components. The ball check valve can pose a problem, however, when pumping fluids mixed with fibers or other solids since solids can jam movement of the ball or prevent sealing engagement of the ball and sealing surface. For these types of material, duckbill check valves have provided one solution. The lips of a resilient duckbill can seal around fibers or other objects without jamming.

Duckbill check valves can also be more suitable for use with air or gas pumps. In these situations, duckbills can provide faster response time and a tighter seal.

The prior art diaphragm pumps have typically been designed for use with one particular type of check valve, not for alternating use with different valves such as ball-type or duckbill type. These pumps have required substantial effort and expense to change valve types. Typically, they have required changing or reworking the manifolds, or reworking the valve seating, along with other often complicated and time consuming disassembly and re-assembly operations.

The prior art pumps have also frequently been designed to utilize only one type of manifold, i.e., a single inlet or outlet or dual inlet or outlet. Thus, changing one or both manifolds from one to the other type has required completely changing the manifold from one type to the other.

OBJECTS OF THE INVENTION

It is therefore an object of the present invention to provide a double diaphragm pump that can relatively easily and quickly be converted from utilizing duckbill to ball check valves and vice versa.

Yet another object is to provide a double diaphragm pump that has one or more manifolds that can be changed relatively quickly and easily from a dual inlet or outlet type to a single inlet or outlet type and vice versa.

Yet another object is to provide such a pump that allows substitution of check valves by removal of the manifolds alone and without any additional machining or reworking of the manifold or the valve seat.

A further object is to provide a dual diaphragm pump with its check valves retained in a single sleeve in the pump body and retained in place by a relatively easily removable manifold.

There are other objects and advantages which will become apparent as the specification proceeds.

SUMMARY OF THE INVENTION

The foregoing and other objects and advantages are achieved by the present invention of a double diaphragm pump. The pump has a first pumping cavity opposite a second pumping cavity, a diaphragm in each cavity, and means for pumping the diaphragms in their respective cavities. The improvement comprises a cap in each cavity having an upper and a lower valve seat, each of which are adapted to slidably retain a duckbill check valve and, in the alternative, a ball check valve. The improvement also includes upper and lower manifolds, each communicating with two of the valve seats. At least one of the manifolds has a first end, a second end, and a removable fitting intermediate the first and second manifold ends. The fitting has a fitting passage intermediate the two fitting ends, which are securable to the first and several manifold ends, respectively.

BRIEF DESCRIPTION OF THE DRAWINGS

The preferred embodiment of the invention is shown in the attached drawings wherein.

DETAILED DESCRIPTION OF THE PREFERRED EMBODIMENT

Figure 1:
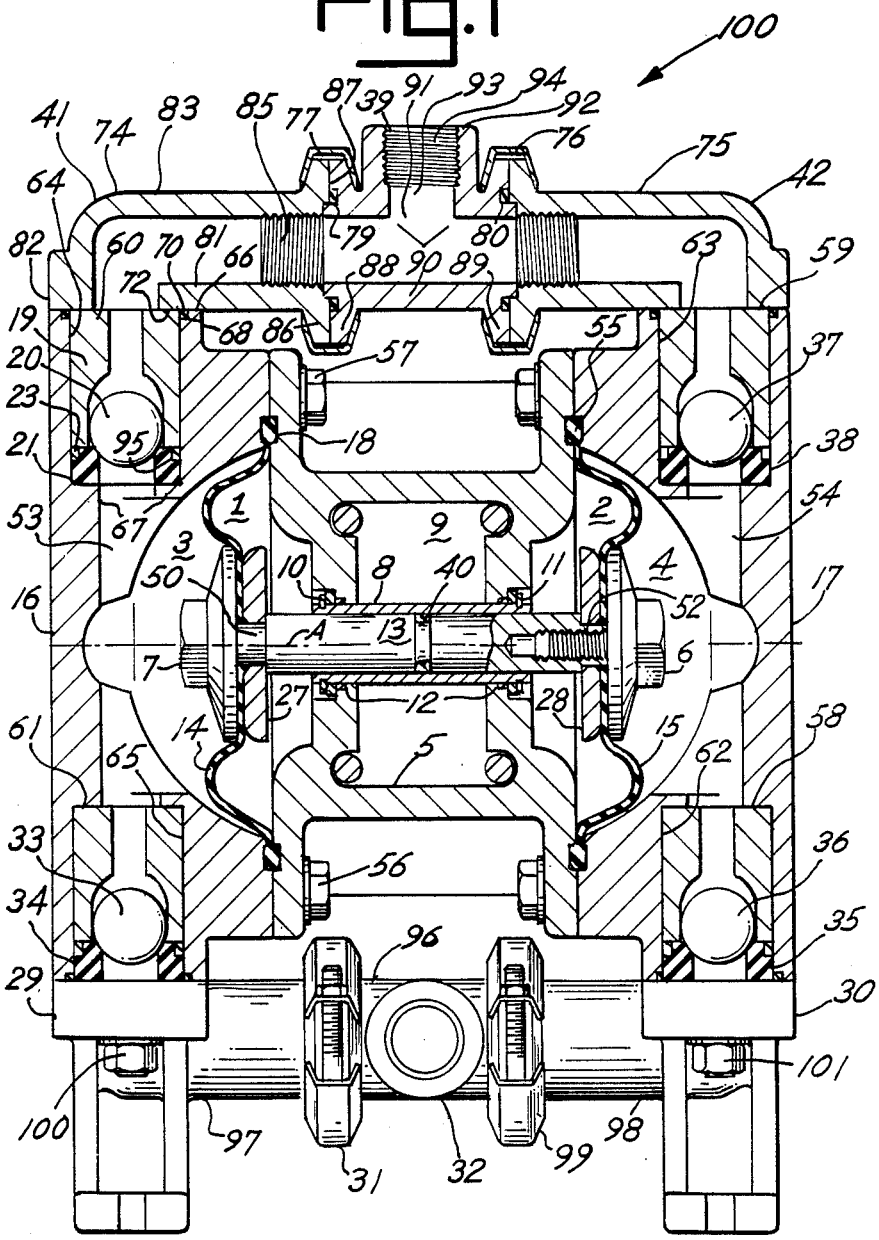
FIG. 1 is a partial cross-sectional view of the preferred embodiment with a single inlet intake manifold, a single outlet exhaust manifold, and four ball check valves secured within the pump by the manifolds.

With reference to FIG. 1, the preferred embodiment is a double diaphragm pump, generally 100, driven by an air motor body 5. The motor body 5 drives a horizontal connecting rod 13 back and forth to the left and right along its axis A. The connecting rod 13 is supported by sleeve 8 in the air motor body 5. The sleeve 8 is retained in the air motor body 5 by retaining rings 10 and 11.

The connecting rod has a left end 50 and a right end 52. The left end 50 penetrates a left pump cavity 53, and the right end 52 penetrates a right pump cavity 54.

A dish-like left diaphragm 14 is secured to the left end 50 of the connecting rod 13 by a left diaphragm retaining nut 7 on one side of the diaphragm 14 and a left diaphragm washer 27 on the other side. A dish-like right diaphragm 15 is secured to the connecting rod's right end 52 by a right diaphragm retaining nut 6 on one side and a right diaphragm washer 28 on the other.

The left pump cavity 53 is formed by (i) a pump or cavity cap 16 spaced from the left side of the left diaphragm 14, and (ii) the left side of the air motor body 5 spaced from the right side of the left diaphragm 15. Similarly, the right pump cavity 54 is formed by (i) a pump or cavity cap 17 spaced from the right side of the right diaphragm 15, and (ii) the right side of the air motor body 5 spaced from the left side of the right diaphragm 15.

The outer circumferential periphery of each diaphragm 14, 15 consists of a bead seal 18, 55, respectively. The bead seal, 18 for example, prevents leakage of air between the left pump cap 16 and the air motor body 5 to which the pump cap 16 is secured by bolts 56, 57.

The left 53 and right 54 pump cavities thus provide areas for pumping movement of the left 14 and right 15 diaphragms. As the air motor body 5 drives the connecting rod 13 towards the left cavity 53, the diaphragms 14, 15 both move rightward within their respective cavities 53, 54. And as the air motor body 5 drives the connecting rod 13 towards the right cavity 54, the diaphragms 14, 15 both move leftward within their respective cavities 53, 54.

As shown in FIG. 1, the preferred embodiment 100 has an intake manifold 41, an exhaust manifold 29, and four check valves 58, 59, 60, 61. The check valves 58-61 shown in FIG. 1 are ball check valves, but they may alternatively be, as shown in FIG. 2, duckbill check valves 62, 63.

Referring again to FIG. 1, each of the check valves 58-61 is similarly retained within their respective valve counterbore or sleeves 62, 63, 64, 65 in the cavity caps 16, 17 in the pump 100. With regard to the upper valve sleeve 64 and associated check valve 60 in the left cavity cap 16, for example, the sleeve 64 is cylindrical and vertically penetrates the planar upper surface 66 of the left cavity cap 16. The lowermost end of the sleeve 64 has a retaining abutment 67 extending radially inwardly from the outer cylindrical perimeter of lowermost end of the sleeve 64. The uppermost end of the sleeve 64 has a manifold seal groove 68 extending somewhat radially outwardly from the sleeve 64 to abut the upper planar surface 66 of the left cap 16.

As shown in FIG. 1, the valve sleeve 64 is thus adapted to retain a ball check valve 60. The ball check valve 60 has (i) an upper ball cage 19, (ii) a lower ball seat or seal 21 abutting on its upper side the lowermost edge of the ball cage 19 and on its lower side the retaining abutment 67 in the cap 16, (iii) a resilient sleeve ring seal 23 penetrating an outer circumferential seal groove 95 in the ball seal 21, and a resilient manifold ring seal 70 penetrating the manifold seal groove 68 abutting the upper surface 66 of the left cap 16.

Figure 2:
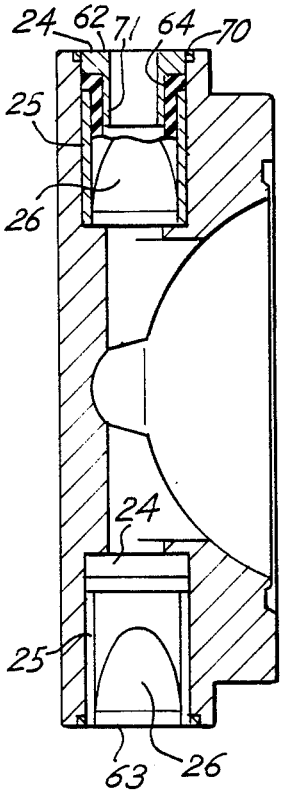
FIG. 2 is a partial cross-sectional view of the left side of FIG. 1 of the preferred embodiment, with two duckbill check valves substituted for the ball check valves shown in FIG. 1.

As shown in FIG. 2, however, the valve sleeve 64 requires no modification whatsoever to accommodate a duckbill check valve 62 rather than the ball seal of FIG. 1. The duckbill check valve 62 has (i) a cylindrical duckbill sleeve 25 abutting the inner periphery of the valve sleeve 64, (ii) a resilient duckbill 26 extending upwardly from the junction of the duckbill 26 with the duckbill sleeve 25 at the lowermost cylindrical edge of the duckbill sleeve 25, (iii) an insert 24 (as shown in cutaway) penetrating the upper end of the duckbill sleeve 25, and (iv) the exhaust ring seal 70 previously described. The insert 24 has a cylindrical extension 71 extending downwardly toward the duckbill 26. The lowermost portion of the cylindrical extension 71 is adjacent the uppermost edge of the duckbill 26 to provide a channel for passage of material or gas through duckbill to the exhaust manifold (shown as 41 in FIG. 1).

Referring again to FIG. 1, the check valve 60 is retained fairly and securely within the sleeve by means of the upper manifold 41. The upper manifold 41 has a planar lowermost surface 72 which abuts the upper surface 66 of the cap 16, the manifold seal 70, and the ball cage 19 to hold the check valve 60 securely but removably in place within the valve sleeve 64. The upper manifold 41 is structured to provide similarly for the duckbill check valve 62 of FIG. 2.

Referring back to FIG. 1 again, the upper manifold 41 is configured as a single inlet manifold. The single inlet configuration has left 74 and right 75 manifold ends, a manifold fitting 76 between the left 74 and right 75 manifold ends, and left 77 and right 78 manifold clamps securing the fitting 76 within the two manifold ends 74, 75. Two fitting seals 79, 80 provide seals at the junctions of the fitting 76 with the left 74 and right 75 manifold ends, respectively.

The left and right manifold ends 74, 75 are configured similarly. Each, 74 for example, is angled at 90°, with a vertically extending arm 82 joining a horizontally extending arm 83 and with an angled flow passage 81 extending through the entire length of the manifold end 74. The side of the horizontally extending arm 83 opposite the junction with the vertical arm 82 has a threaded section 85 penetrating the flow passage 81. Extending radially outwardly from the threaded section 85 is a clamp flange 86. The clamp flange 86 has a planar vertical surface 87 for sealing abutment with the left edge of the fitting 76.

The fitting 76 is "T" shaped. It has a central horizontal "T" section 90 with clamp flanges 88, 89 on the horizontally opposing edges of the "T" section 90. A central fitting passage 91 extends the horizontal length of the "T" section 90, and an angled nipple 92 extends from the center of the "T" section 90 at a 90° angle to it. A nipple passage 93 extends through the nipple 92 to penetrate and communicate with the fitting passage 91. The uppermost portion of the nipple passage also has a threaded section 94 to provide a junction with tubing (not shown) for transfer of flow materials from the manifold 41 to the tubing or vice versa.

As shown for the lower manifold 32, the lower "T" fitting 96 is held in place between the two manifold ends 97, 98 by two, screw-type clamps 31, 99. Also, the lower manifold 32 is secured to the pump with four bolts 100, 101, 102, 103 (102 and 103 not shown) which penetrate bolt passages (not shown) in the opposing manifold ends 97, 98 extending into the respective cavity caps 16, 17. The upper manifold 41 is similarly arranged and secured in place.

Figure 3:
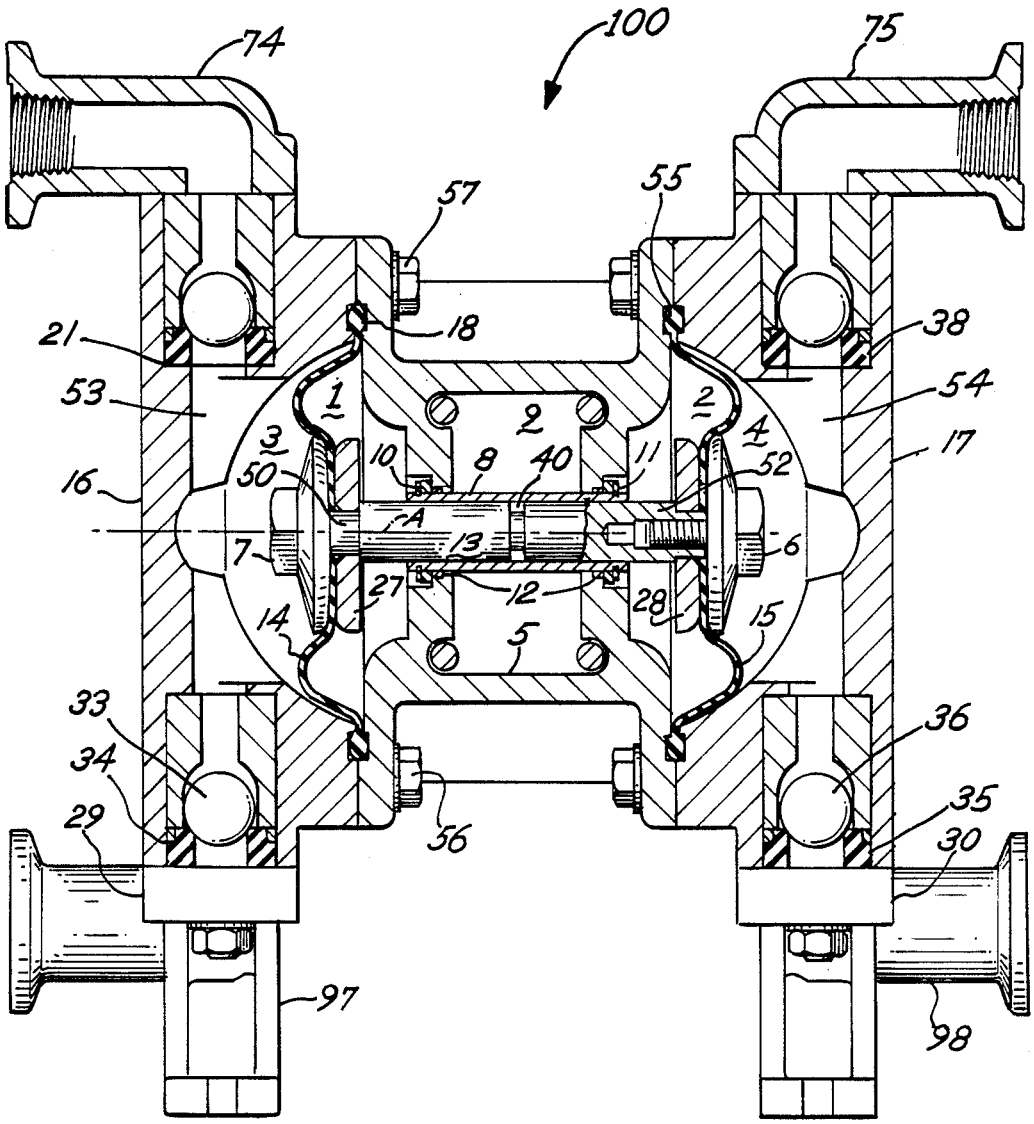
FIG. 3 is a partial cross-sectional view of the preferred embodiment with the intake and exhaust manifolds converted into a dual intake manifold and a dual exhaust manifold, with the dual intake inlets at 180° angles to each other and the dual exhaust outlets at 180° angles to each other.

Referring now to FIG. 3, the preferred embodiment 100 is relatively easily converted from one inlet, one outlet system of FIG. 1 to the two inlet, two outlet system of FIG. 3. The conversion is accomplished by simply (i) unscrewing, as shown in FIG. 1, the expandable clamps 31, 99 holding lower fitting 96 in place on the lower manifold 32, (ii) removing the fitting 96 and clamps 31, 199, (iii) unbolting the manifold ends 97, 98, (iv) rotating each manifold end 97, 98 by 180°, and (v) rebolting the manifold ends 97, 98 in their respective locations to abut the left 16 and right 17 cavity caps respectively.

The same can be done for, as shown in FIG. 3, the upper manifold ends 74, 75. The upper manifold ends 74, 75 are bolted to, and unbolted from, their respective cavity caps 16, 17 just as the lower manifold ends 97, 98 are, as explained above. (The bolts for the upper manifold ends 74, 75 are not shown in order to reveal in cross-section the internal passageway structure of all the manifold ends 97, 98, 74, and 75.)

When thus arranged as a two inlet, two outlet system, the internal threaded section 85 can provide a secure threadable junction with tubing (not shown) for delivering and removing pumped materials.

It can be seen that the improved embodiment provides a pump that easily accommodates both duckbill and ball-type check valves. Moreover, it does so utilizing one type of manifold, and the manifolds are easily converted, either one or both, from a single inlet/outlet arrangement to a dual inlet/outlet structure and vice versa.

The foregoing is a detailed description of the preferred embodiment and is thus illustrative rather than restrictive. The scope of the invention is thus measured by the following claims.

What is claimed is:

1. In a double diaphragm pump having a first pumping cavity, a second pumping cavity, a first diaphragm in the first pumping cavity, a second diaphragm in the second pumping cavity, a valved inlet and outlet for each cavity and means for actuating the first diaphragm and second diaphragm reciprocally within their respective cavities for pumping fluid into and out of the cavities through the respective inlet and outlet the improvement comprising:

(a) a first cap defining the first pumping cavity and a second cap defining the second pumping cavity, each of said fluid caps having an upper counterbore and a lower counterbore adapted to slidably retain a duckbill check valve and, alternatively, a ball check valve said duckbill check valve comprising a sleeve, and insert cooperatively retaining a resilient duckbill within a counterbore, said ball check valve comprising a ball cage and cooperative seat retaining a ball within a counterbore; both said duckbill check valve and said ball check valve being sized to fit into the counterbore;

(b) an upper manifold member and a lower manifold member for each of said caps, each manifold member being substantially identical and defining a fluid flow passage having a first end communicating with a valve passage from a fluid cap and a second end at a right angle to the first end, said manifold members being secured to the caps optionally (1) in a first orientation with the second ends of manifold members on the first and second caps opposed to one another for cooperation with a single T-shaped fitting to thereby provide a single fluid passage from the pumping cavities, or (2) in a second orientation with the second ends of the manifold members unopposed to each other whereby separate passages are provided for each pumping cavity.

* * * * *